US005460072A

United States Patent [19]

Ferdon

[11] Patent Number: 5,460,072

[45] Date of Patent: Oct. 24, 1995

[54] TUNING BLOCK FOR A GUITAR WITH A FLOATING BRIDGE TREMOLO

[76] Inventor: Geoffrey W. Ferdon, 201 Sloan St., Apt. #3, Clemson, S.C. 29631

[21] Appl. No.: 123,072

[22] Filed: Sep. 20, 1993

[51] Int. Cl.[6] ..... G10D 3/00

[52] U.S. Cl. ..... 84/313; 84/312 R; 84/453

[58] Field of Search ..... 84/313, 312 R, 84/453

[56] References Cited

U.S. PATENT DOCUMENTS

| | | | |
|---|---|---|---|
| 2,972,923 | 2/1961 | Fender | 84/313 |
| 3,466,962 | 9/1969 | Cole | 84/313 |
| 4,686,883 | 8/1987 | Piche et al. | 84/313 |
| 4,697,493 | 10/1987 | Ralston | 84/313 |
| 4,724,737 | 2/1988 | Fender | 84/313 |
| 4,802,397 | 2/1989 | Petschulat | 84/313 |
| 4,882,967 | 11/1989 | Rose | 84/313 |
| 4,928,564 | 5/1990 | Borisoff et al. | 84/313 |

*Primary Examiner*—Steven L. Stephan
*Assistant Examiner*—Cassandra Spyrou
*Attorney, Agent, or Firm*—Rogers & Killeen

[57] ABSTRACT

A tuning block for rapidly tuning a guitar having a floating bridge tremolo. The tuning block has a base that may be removably inserted between the body of the guitar and the tremolo bridge to limit the pivoting motion of the bridge and thereby tune the strings of the guitar as a group. A tuning bar is pivotably attached to the base and carries individual string tension contacts for modifying the tension of each string when the tuning bar is pivoted into position atop the string tension levers on the tremolo bridge. The string tension contacts may be adjusted to depress the tremolo string tension levers, thereby tuning the guitar. The tuning block may be quickly attached to the tremolo bridge and the tuning bar pivoted into position to tune the guitar to a predetermined setting.

22 Claims, 3 Drawing Sheets

TUNING BLOCK FOR A GUITAR WITH A FLOATING BRIDGE TREMOLO

BACKGROUND OF THE INVENTION

The present invention relates to tuning blocks for guitars with floating bridge tremolos and more particularly to a method and device for selectively and quickly changing the tuning of such a guitar.

Many modern electric guitars are equipped with a floating bridge tremolo for producing a vibrato effect. Floating bridge tremolos have a tremolo bridge and a tremolo bar, and are operated by selectively depressing and releasing the tremolo bar that pivots the tremolo bridge, thereby changing the tension of the strings as a group. When the vibrato effect is no longer desired, the tremolo bar is released, the tremolo bridge returns to its original position, and the guitar strings return to their original tension.

When performing in front of an audience, sometimes it is necessary for a musician to change the tuning of the guitar for a particular song. Under these conditions it is impractical to go through the time consuming process of retuning the guitar. Instead, some musicians simply use another guitar that has been pretuned for the song. This solution is obviously costly and many musicians cannot afford the extra guitars needed for a complete repertoire, forcing them to change their song selections, or to accept less than optimum tuning.

As an alternative solution, some musicians use guitars having floating bridge tremolos that are equipped with devices that fix or limit the pivoting motion of the tremolo bridge to thereby change the tension of the strings as a group and thus the overall tuning of the guitar. However, the change in the tuning of each string of the guitar varies with its thickness, and devices that change the tension of all the strings by the same amount may place one or more of the strings out of tune because of its different thickness (see, for example, U.S. Pat. No. 4,882,967 issued to Rose on Nov. 28, 1989). As a result, if the musician does not have another guitar tuned for a particular song and instead uses a guitar having a retuning device that adjusts the tension of the strings as a group, he must compromise fine tuning for the general tuning of the guitar and hope that the audience does not recognize the flaw.

Accordingly, it is an object of the present invention to provide a novel method and device for tuning a guitar having a floating bridge tremolo that quickly changes the tune of the guitar strings both as a group and individually.

It is another object of the present invention to provide a novel method and device for tuning a guitar in which the tuning of the guitar can be selectively preset for a particular song.

It is a further object of the present invention to provide a novel method and device for tuning a guitar that can be quickly and easily installed on the tremolo.

It is yet a further object of the present invention to provide a novel method and device for tuning a guitar in which a tuning block is inserted between the tremolo bridge and the body of the guitar and in which the tension of individual strings may be unequally set upon insertion.

It is still a further object of the present invention to provide a novel method and device for tuning a guitar in which a variable thickness tuning block for equally adjusting the tension of the strings also has a selectively engaged tuning bar for simultaneously unequally adjusting the tension of each string.

These and many other objects and advantages of the present invention will be readily apparent to one skilled in the art to which the invention pertains from a perusal of the claims, the appended drawings, and the following detailed description of preferred embodiments.

DESCRIPTION OF PREFERRED EMBODIMENTS

The tuning block of the present invention may be used with an electric guitar having a floating bridge tremolo, and is preferably used with such tremolos that have levers for individually adjusting the tension of each string when depressed.

Figure 1:
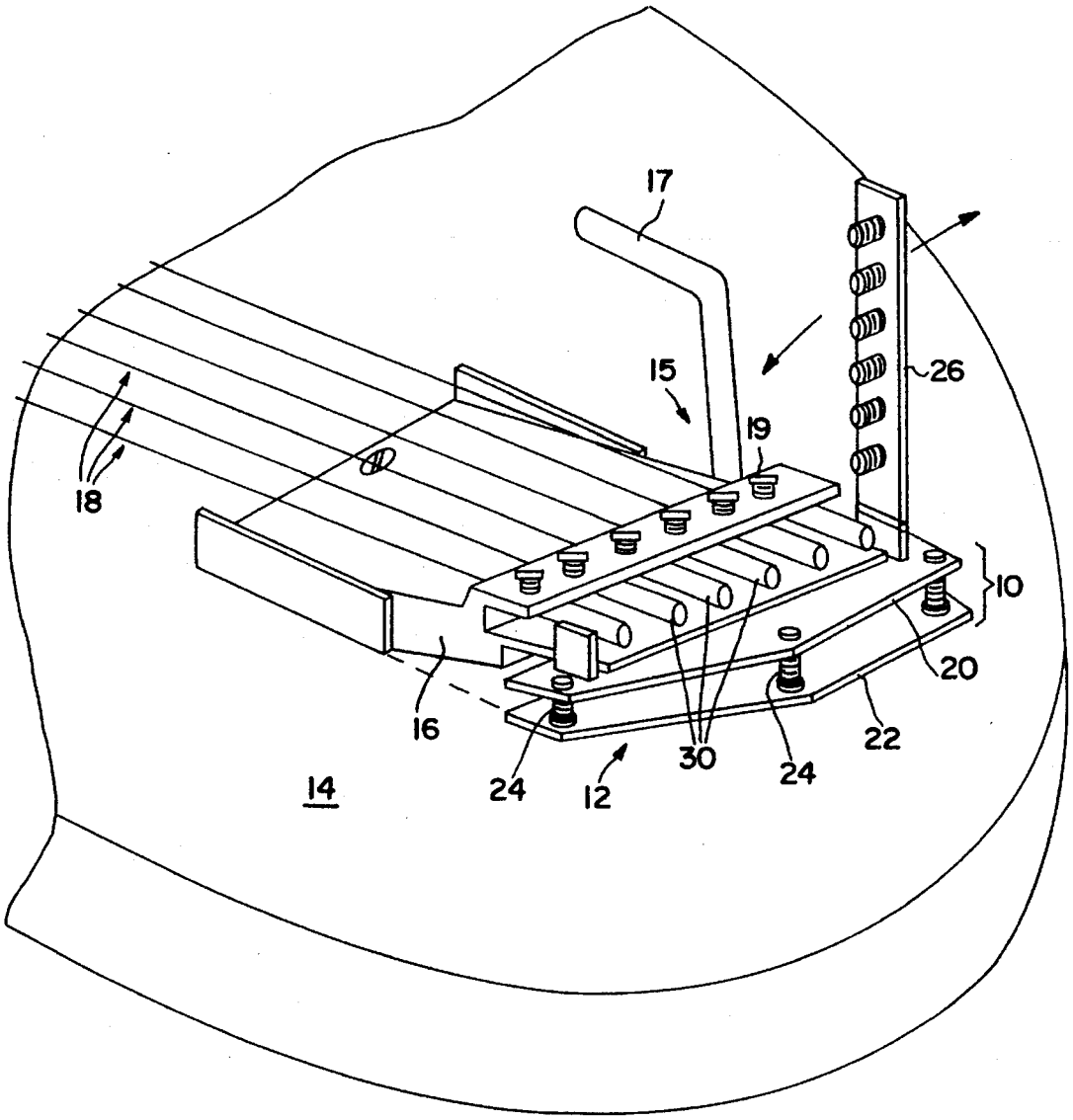
FIG. 1 is a pictorial representation of an embodiment of the present invention attached to a guitar having a floating bridge tremolo.

With reference now to FIG. 1, an embodiment of the tuning block 12 of the present invention is shown in use with a guitar 14 having a floating bridge tremolo 15 with a bridge 16 and tension adjustment levers 30 for each string. The tremolo bridge 16 pivots in response to movement of the tremolo bar 17 to produce a vibrato effect. The pivoting motion changes the tension in the strings 18 as a group. When the tremolo is not being used, the tremolo bridge "floats" to its original position under tension from the tremolo mechanism. Fine tuning may be accomplished by depressing the levers 30 (e.g., with screws 19) to change the tension in individual strings 18.

The base 10 of the tuning block 12 may be positioned between the guitar 14 and the tremolo 15 to limit the pivoting motion of the tremolo bridge 16. When the base 10 is positioned between the guitar body and the tremolo bridge 16, movement of the tremolo bridge 16 is limited so that it cannot return to its original position, thereby changing the tension of the strings 18 as a group.

The base 10 may include spaced apart top and bottom platforms 20, 22 and spacers 24 for selectively varying the distance between the platforms 20, 22 to thereby vary the thickness of the base 10. The top and bottom surfaces of the platforms 20, 22 may be sufficiently resilient to prevent any marring of the guitar 14 or of the tremolo bridge 16, and may, for example, be covered with a layer of any suitable conventional material such as felt or rubberized fabric.

In a preferred embodiment the top and bottom platforms 20, 22 are separated and aligned by spacers 24 that may be threaded into the top platform 20 so that selective rotation of the spacers 24 varies the distance between the top and bottom platforms 20, 22, thereby varying the thickness of the base 10. The thickness of the base 10 may be varied uniformly, or varied so that the top platform 20 is tilted as illustrated by the dashed lines in FIG. 3. Retaining rings or the like may be used to hold the spacers 24 in the bottom platform 22 and so that rotation of the spacers 24 does not cause them to project through the bottom platform into the guitar. In operation, the spacers may be set so that the bottom platform 22 is parallel to and in contact with the guitar 14 while the top platform 20 is parallel to and in contact with the tremolo bridge 16. The thickness of the base 10 may be set for a desired tuning of the guitar.

Figure 2:
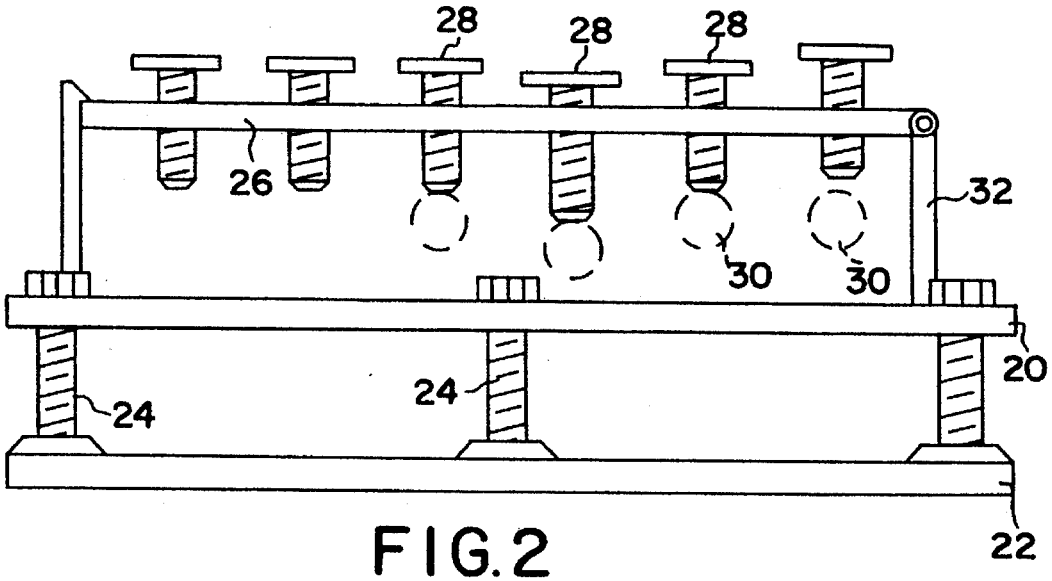
FIG. 2 is a rear view of an embodiment of the present invention with the tuning bar in the engaged or closed position.

A tuning bar 26 carrying a plurality of selectively variable, individual string tension contacts 28 may be attached to the top platform 20 of the tuning block 12. The tuning bar 26 may be pivotably attached so that when the base 10 is positioned between the guitar 14 and the tremolo bridge 16, the tuning bar 26 may be pivoted from a disengaged or open position spaced away from and out of contact with the bridge 16, such as shown in FIG. 1, to an engaged or closed position located parallel to and in contact with the bridge 16, such as shown in FIG. 2. When the tuning bar 26 is closed, the string tension contacts 28 may selectively engage and depress the individual string tension levers 30 on the tremolo bridge 16, thereby tuning each of the strings 18 individually.

The individual string tension contacts 28 may be threaded through holes in the tuning bar 26 so that a portion of each contact 28 protrudes from the bottom side thereof. The amount of protrusion may be selectively varied by rotating the contacts 28. When the tuning bar is pivoted to the engaged position such as shown in FIG. 2, selected string tension contacts 28 engage and depress the corresponding string tension levers 30 causing the tension in the corresponding strings to change.

Figure 3:
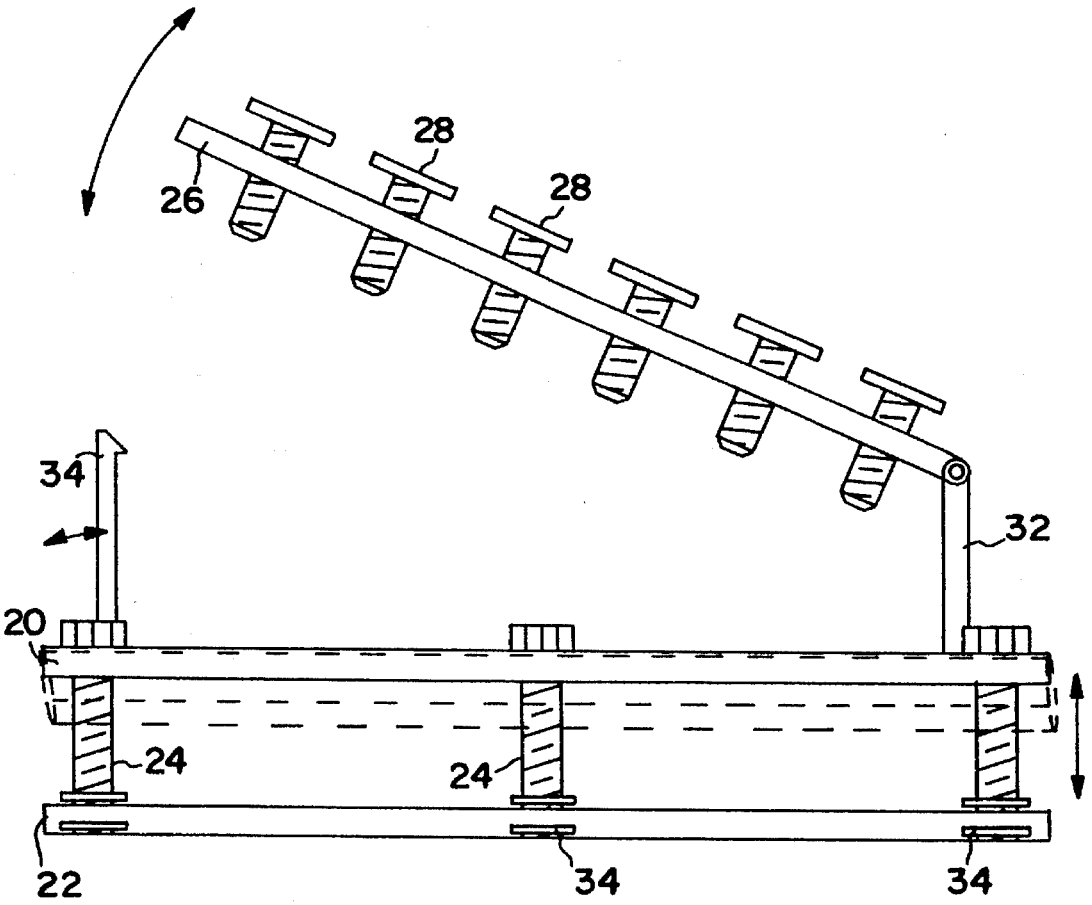
FIG. 3 is a rear view of an embodiment of the present invention with the tuning bar in the disengaged or open position.

The tuning bar 26 may be attached to the base 10 of the tuning block 12 by any suitable conventional means so that the tuning bar 26 can be pivoted from a position away from and out of contact with the bridge 16 to a secured position parallel to and in contact with the bridge 16 such as shown in FIG. 3. For example, as illustrated in FIGS. 2 and 3, one end of the tuning bar 26 may be hinged to a member 32 projecting from the top platform 20. When pivoted to the engaged position, the free end of the tuning bar 26 may be latched to a second member 34. The second member 34 may be flexible so that a lip may hold the bar 26 in place. By way of further example, the tuning bar 26 may be provided with two legs, with one of the legs hinged to the top platform 20 so that the tuning bar may be pivoted to and from its engaged position where the second leg may be removably attached to the top platform 20. In another example illustrated in FIG. 4, the tuning bar 26 may be held with a long screw 27 that extends through a hole in the unhinged end of the tuning bar 26, replacing the second member 34. The tuning bar 26 may be secured in the closed position by fastening an optional wing nut to the screw 27.

The tuning block 12 may be held in position with conventional attachment devices that attach the block 12 to the tremolo 15 or to the guitar 14, such as braces, clamps, screws, removably attachable adhesives le.g., VELCRO®l, etc. For example, the guitar may be fitted with threaded holes for receiving the spacers 24, or other screws through the bottom platform 22. By way of further example, the top platform 20 may be removably clamped to the tremolo bridge 16 with a C-clamp. Alternatively, the tuning block 12 may be held in position by the pressure of one or more of the string tension contacts 28 on the levers 30 (in normal operation the tuning bar is opened only when the tuning block 12 is being removed or attached). The lever 30 that is depressed the most (typically one of the levers 30 at the end of the row of levers) may be pressed against the top platform 20 and held by a string tension contact 28.

Figure 4:
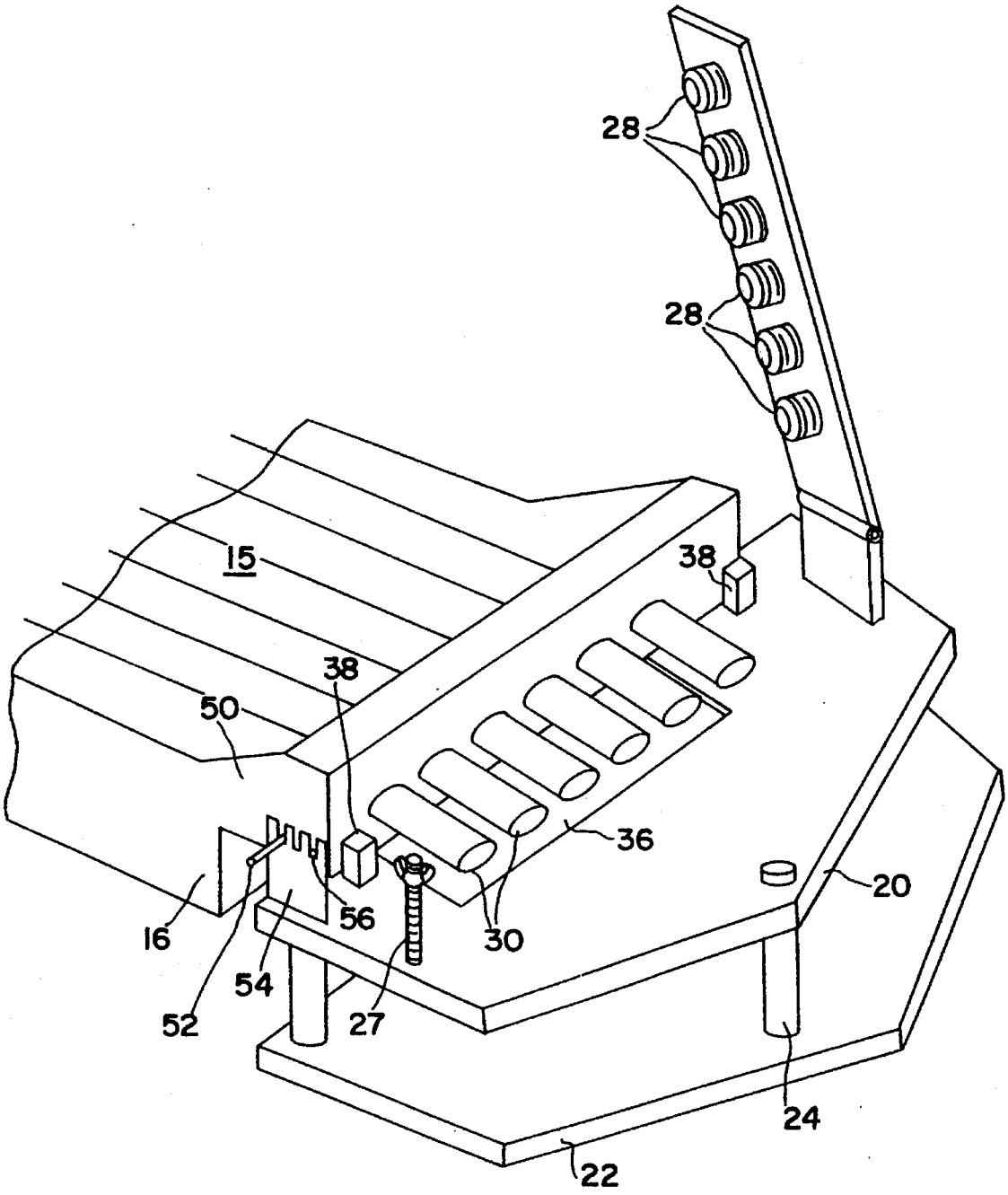
FIG. 4 is a pictorial representation of an alternative embodiment of the present invention attached to a guitar with a floating bridge tremolo.

As illustrated in FIG. 4, the block 12 may also include one or more relocatable positioning members 38 to place the tuning block 12 in a desired position (or the same position) relative to the bridge 16 each time it is used. When the tuning block 12 is being wedged into place between the guitar and the tremolo, the members 38 stop movement at a predetermined position. The positioning members 38 may be located on the top platform 20 as shown or elsewhere, depending on the structure of the tremolo with which the present invention is used. The positioning members 38 and tuning block 12 may have corresponding male and female members, or other conventional removable attachment devices, so that the positioning members 38 can be selectively moved from one position to another. The block 12 may also be held in a predetermined position with a pin and detent mechanism 50 such as illustrated in FIG. 4. The pin 52 may extend from the tremolo 15 into a block 54 with detents 56 for the pin.

With further reference to FIG. 4, in another embodiment of the present invention the top platform 20 may have a section 36 removed therefrom so that the string tension contacts 28 may depress the string tension levers 30 to a position below the top platform 20 to thereby increase the range of individual string tuning.

In operation, the tuning block may be used to quickly, easily and completely modify the tuning of the guitar. By way of example, initially the thickness of the base 10 and the position of each string tension contact 28 may be preset for a particular song. Thereafter, when the song is to be played, the tremolo bar may be depressed to pivot the tremolo bridge 16 away from the guitar 14, the base 10 of the tuning block 12 positioned between the guitar and the bridge 16 with the tuning bar 26 in the disengaged position, the tremolo bar may then be released, and the tuning bar 26 pivoted from the disengaged position to the engaged position. Upon completion of the song, the steps may be reversed to remove the tuning block 12, and another preset tuning block 12 of the present invention may be installed for the next song.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. A tuning block for a guitar having a floating bridge tremolo, the tuning block comprising:

spaced apart top and bottom platforms;

a plurality of spaced apart, selectively adjustable spacers between said top and bottom platforms for selectively varying a distance between said platforms whereby movement of the floating tremolo bridge is selectively limited and tension of strings of the guitar varied as a group when said platforms are positioned between the guitar and the floating tremolo bridge, said bottom platform having a lower surface substantially covered with a resilient surface for protecting the guitar when said bottom platform is placed in pressural engagement with an upper surface of the guitar, said top platform having a portion covered with a resilient upper surface for protecting the floating tremolo bridge when said top platform is placed in pressural engagement with a lower surface of the floating tremolo bridge; and a rigid tuning bar pivotably carried by said top platform, said bar having a generally planar portion with a plurality of manually presetable, individual string tension contacts spaced along a length thereof, said tuning bar being pivotably attached to said top platform whereby said bar is selectively movable from a first position away from the upper surface of said top platform with said tension contacts out of contact with the floating tremolo bridge to a second position adjacent to and substantially parallel to the upper surface of said platform with said tension contacts in contact with the floating tremolo bridge such that said tension contacts engage a plurality of string tension devices on the floating tremolo bridge.

2. The tuning block of claim 1 wherein said string tension contacts comprise threads for rotatably engaging said tuning bar.

3. The tuning block of claim 1 further comprising a positioning member on said top platform for holding said platforms in a position relative to the floating bridge tremolo.

4. The tuning block of claim 3 wherein said positioning member comprises a block with detents for receiving a pin extending from the floating bridge tremolo.

5. The tuning block of claim 1 further comprising a block on said upper surface for placing said platforms in a predetermined position relative to the floating bridge tremolo.

6. The tuning block of claim 1 further comprising means for holding said tuning bar in said second position.

7. The tuning block of claim 6 wherein said means for holding comprises a flexible member with a lip for holding said tuning bar in said second position.

8. The tuning block of claim 6 wherein said means for holding comprises a screw and wing nut for holding said tuning bar in said second position.

9. A method for simultaneously and unequally tuning strings of a guitar having a floating bridge tremolo comprising the steps of:

(a) providing a variable thickness tuning block with a pivotable tuning bar having a plurality of guitar string tension contacts;

(b) selectively presetting a thickness of the tuning block;

(c) selectively presetting each of the plurality of individual guitar string tension contacts carried by the tuning bar;

(d) positioning the tuning block between the guitar and the floating bridge tremolo; and (e) pivoting the tuning bar across the floating bridge tremolo so that the string tension contacts simultaneously individually tune the strings of the guitar.

10. The method of claim 9 further comprising the step of providing a positioning member on an upper surface of the tuning block for holding the tuning block in a position relative to the floating bridge tremolo.

11. The method of claim 9 further comprising the step of providing a pin on the floating bridge tremolo and a detented block on an upper surface of the tuning block, the detented block having detents for the pin to hold the tuning block in a position relative to the floating bridge tremolo.

12. The method of claim 9 further comprising the step of holding the tuning block in position relative to the floating tremolo bridge by pressural engagement of at least one of the string tension contacts with the floating bridge tremolo.

13. A tuning block for a guitar having a floating bridge tremolo, the tuning block comprising:

block means for being inserted between the guitar and the floating bridge tremolo for simultaneously tuning the guitar strings the same amount by modifying the relationship of the floating bridge tremolo relative to the guitar; and selectively disengagable means carried by said block means for simultaneously tuning the guitar strings individually upon engagement.

14. The tuning block of claim 13 wherein said selectively disengagable means includes a tuning bar pivotally carried by said block means, and wherein said tuning bar comprises a plurality of individual guitar string tuning means for selectively adjusting the tension of individual guitar strings.

15. The tuning block of claim 13 further comprising means for selectively positioning said block means in a predetermined position relative to the floating bridge tremolo.

16. The tuning block of claim 13 further comprising means for securing said selectively disengagable means to the floating tremolo bridge.

17. The tuning block of claim 13 further comprising means for securing said block means to the guitar.

18. A tuning block for a guitar having a floating bridge tremolo with a movable portion for producing a vibrato effect, the tuning block comprising:

block means for being inserted between the guitar and the floating bridge tremolo to tune the guitar strings by modifying the relationship of the movable portion relative to the guitar; and means for selectively positioning said block means in a predetermined position relative to the movable portion.

19. The tuning block of claim 18 further comprising a tuning bar pivotably carried by said tuning block for selectively tuning the guitar strings individually.

20. The method of claim 18 wherein said means for selectively positioning comprises a barricade on an upper surface of the block means that is in contact with the movable portion when said block means is in the predetermined position.

21. The method of claim 20 wherein said barricade and said upper surface comprise corresponding male and female members for selectively placing said block means in predetermined positions relative to the movable portion.

22. The tuning block of claim 5 wherein said block and said upper surface comprise corresponding male and female members for selectively placing said platforms in predetermined positions relative to the floating bridge tremolo.

* * * * *